US005591025A

United States Patent [19]

Invernizzi

[11] Patent Number: 5,591,025

[45] Date of Patent: Jan. 7, 1997

[54] COMBUSTION HEAD, IN PARTICULAR FOR GAS BURNERS

[76] Inventor: Gianmario Invernizzi, Via Montessori, 26, 22053 Lecco (LC), Italy

[21] Appl. No.: 506,361

[22] Filed: Jul. 24, 1995

[51] Int. Cl.[6] ..... F23D 14/14

[52] U.S. Cl. ..... 431/329

[58] Field of Search ..... 431/328, 329

[56] References Cited

U.S. PATENT DOCUMENTS

| | | | |
|---|---|---|---|
| 1,256,301 | 2/1918 | Ellis | 431/328 |
| 3,322,179 | 5/1967 | Goodell | 431/328 |
| 3,847,536 | 11/1974 | Lepage | 431/329 |
| 3,947,233 | 3/1976 | Sundberg | 431/328 |
| 4,154,568 | 5/1979 | Kendall et al. | 431/328 |
| 4,900,245 | 2/1990 | Ahmady | 431/328 |

FOREIGN PATENT DOCUMENTS

| | | | |
|---|---|---|---|
| 0542074A2 | 2/1992 | European Pat. Off. . | |
| 2036510 | 2/1971 | Germany . | |
| 4229070 | 3/1993 | Germany | 431/329 |
| 68-258917 | 11/1987 | Japan | 431/329 |
| 1121609 | 5/1989 | Japan . | |
| 452464 | 5/1968 | Switzerland . | |
| 2155613 | 9/1985 | United Kingdom . | |
| 2259566 | 3/1993 | United Kingdom . | |

*Primary Examiner*—Carroll B. Dority
*Attorney, Agent, or Firm*—Laff, Whitesel, Conte & Saret, Ltd.

[57] ABSTRACT

It is described a combustion head consisting of a plurality of balls (10) of ceramic material joined to each other at points of mutual tangency to substantially form a filter bed. On passing through the ceramic head, the combustible gas-combustion air mixture is shared out among a multiplicity of hollow spaces (11) following each other to form a tortuous path, in order to ensure an optimal mixing. At the combustion head exit the gas-air mixture fires forming a flame front extending over the whole external surface (1*a*) of the combustion head.

25 Claims, 3 Drawing Sheets

FIG1
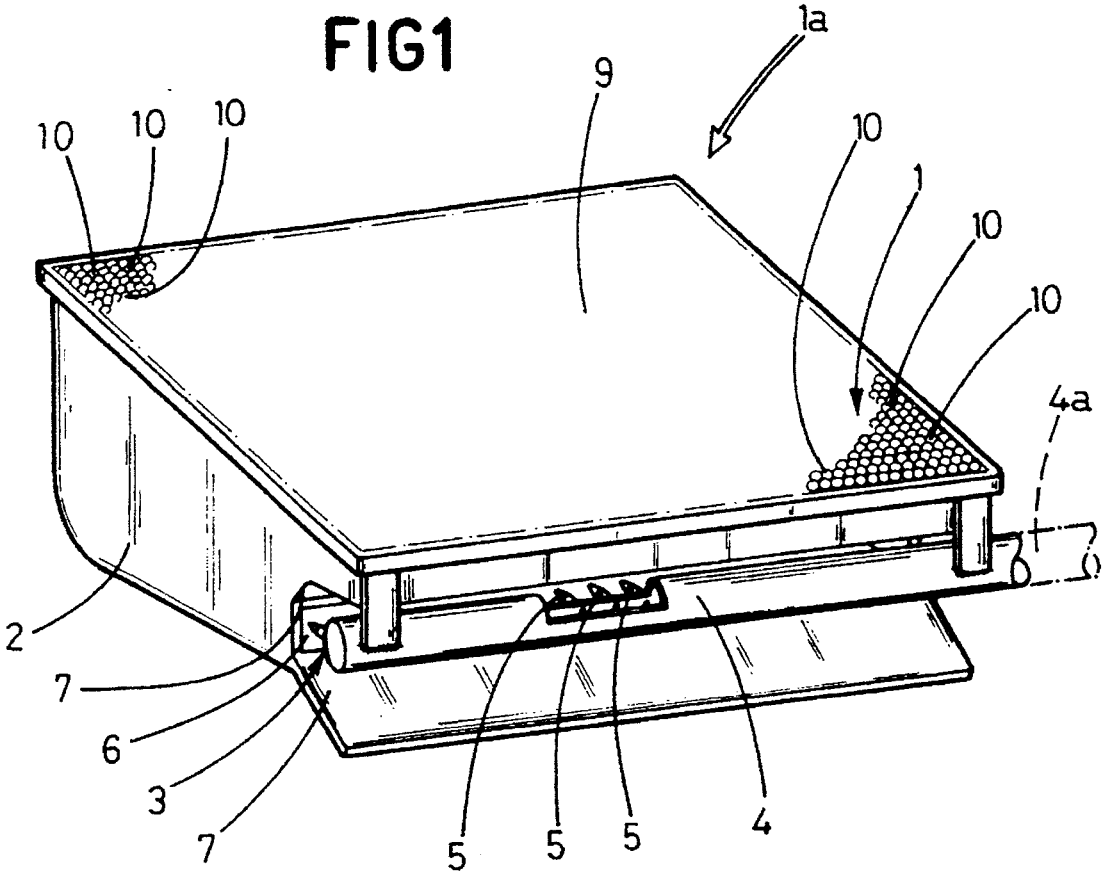
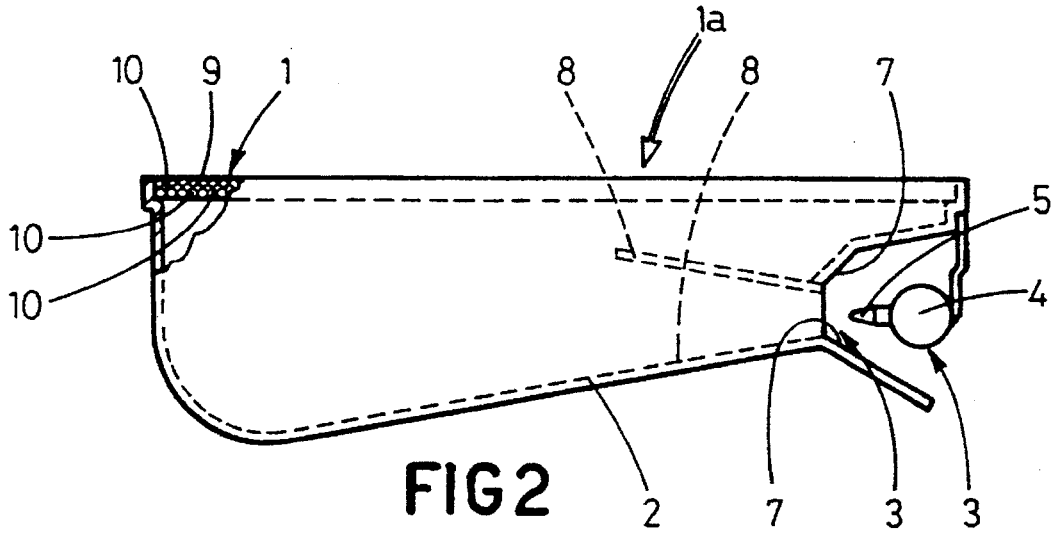
FIG2
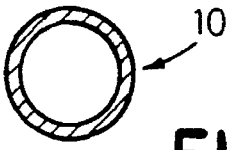
FIG7

COMBUSTION HEAD, IN PARTICULAR FOR GAS BURNERS

BACKGROUND OF THE INVENTION

1. Field of the Invention

The present invention relates to a combustion head, in particular for gas burners of the type involving the use of an internally hollow mixing body and means for feeding a combustible gas-combustion air mixture into the mixing body, said combustion head being provided with delivery ports through which the combustible gas-combustion air mixture is ejected from the mixing body and fired.

In the above described solution the combustion head in question is conceived in particular for employment in small boilers and similar heating apparatuses for home use. However, the innovatory concepts suggested by the present invention can be validly adopted to produce any other type of burner, be it an atmospheric or an aerated burner with forced ventilation, to be also employed in furnaces or heating systems of an industrial type.

2. Prior Art

It is known that burners normally used in boilers, furnaces or other heating systems for domestic and/or industrial use fed with gaseous fuel essentially consist of an internally hollow mixing body generally of a box-shaped structure, provided with means for the controlled admission of a combustible gas and combustion air drawn from the surrounding atmosphere. Associated with the upper part of the mixing body is a combustion head in which a plurality of ports is formed for delivery of the combustible gas-combustion air mixture from the inside of the mixing body.

In burners of the most widely spread type, said delivery ports essentially consist of mere through holes having a round or shaped configuration, formed through a metal plate constituting the combustion head. The combustible gas-combustion air mixture is fired at the exit of said through holes, thereby forming a plurality of flames arising from the external surface of the combustion head. While the combustion heads of the above type are adopted in many situations, they however have some drawbacks in terms of burning efficiency. In particular, the air-gas mixing carried out within the mixing body does not always appear sufficiently efficient to ensure an optimal and intimate mingling of the two components, which is essential for achieving a correct burning.

There are also burners the combustion head of which essentially consists of a wire net having meshes of an appropriate size to give the outgoing gas-air mixture such a speed that the risk of backfire towards the mixing body is avoided. In burners of this type, burning gives rise to a continuous flame front substantially covering the whole external surface of the combustion head. In addition, heat resulting from combustion taking place in direct contact with the wire net causes said net to become incandescent and, as a result, to dissipate heat by radiation. Hence it follows that the combustion heads of this type ensure a combustion of better quality as compared with those described beforehand, but on the other hand they have a drawback too in that the wire nets, in addition to being very expensive, exhibit a structural brittleness that in many cases makes it inconvenient to use them.

Also provided are other burners the combustion head of which substantially consists of one or more plates made of a ceramic material having a honeycomb structure and obtained by molding. These ceramic plates have a greater structural strength than the previously described wire nets, but they involve high production costs too and, in addition, have a reduced resistance to thermal shocks. Furthermore, also in burners provided with such a type of combustion head, the gas-air mixing carried out within the mixing body does not prove to be sufficient for ensuring an optimal combustion development, above all in the cases in which the air and gas flow rate values must be adjusted for achieving a flame modulation.

Burners have been also manufactured in which the combustion head essentially consists of a porous ceramic material or a non-woven fabric formed of ceramic material fibers. This type of combustion head has a greater resistance to thermal shocks as compared with that of the ceramic material plates. However, also porous ceramic materials and non-woven fabrics involve high production costs and above all do not allow a precise measurement of the delivery ports embodied by the hollow spaces created between the various ceramic material fibers or particles having a random orientation. Therefore very thick porous materials or non-woven fabrics need to be adopted. But, on the other hand, an important thickness appears to be inappropriate, due to the flow resistance induced on the outgoing mixture, for use on burners of the atmospheric type requiring air to be fed by forced ventilation. An important thickness also involves the installation of auxiliary air and/or gas filtering devices, in order to avoid the risk that dust or other impurities may obstruct the hollow spaces between the ceramic fibers or particles, impairing the thereby burner operation.

SUMMARY OF THE INVENTION

It is a main object of the present invention to substantially solve the problems of the known art by providing a combustion head combining a low production cost capable of justifying its employment also on burners of small-sized apparatuses for home use, and excellent qualities in terms of flexibility of use, burning efficiency, structural strength and resistance to thermal shocks.

The above and still further objects that will become more apparent in the course of the present description are substantially achieved by a combustion head, in particular for gaseous fuel burners, comprising a plurality of granular elements physically interconnected with each other in succession at points of mutual tangency, to substantially define a filter bed having a lattice of hollow spaces intercommunicating with each other and defining on an external surface of the combustion head, a plurality of said delivery ports distributed over the whole extension of the external surface itself.

BRIEF DESCRIPTION OF THE DRAWINGS

Further features and advantages will be best understood from the detailed description of some preferred embodiments of a combustion head, in particular for gas burners, according to the present invention, taken hereinafter by way of non-limiting example with reference to the accompanying drawings, in which:

FIG. 1 is a diagrammatic perspective view of a burner provided with a combustion head made in accordance with the invention;

FIG. 2 is a section taken along line II—II in FIG. 1;

FIG. 7 is an enlarged sectional view of a ceramic ball belonging to a combustion head obtained according to a further embodiment of the invention;

DESCRIPTION OF THE PREFERRED EMBODIMENTS

Figure 4:
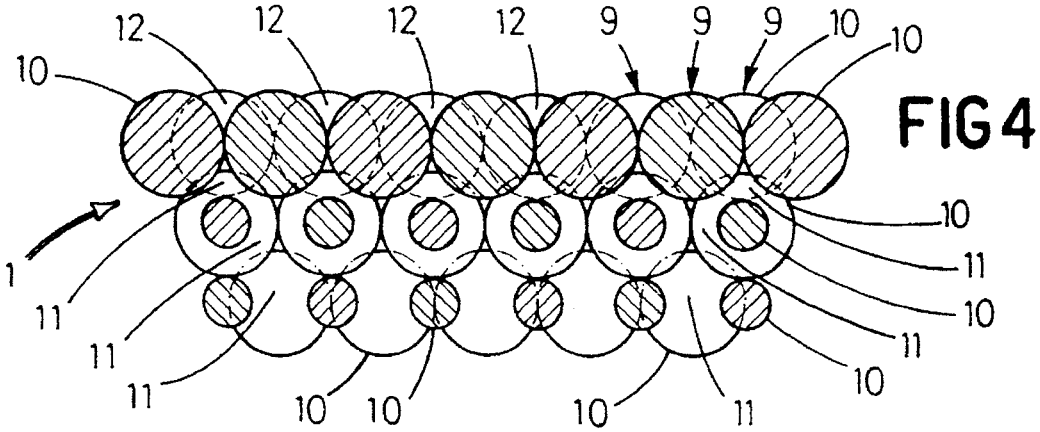
FIG. 4 is a section taken along line IV—IV in FIG. 3.

Referring to the drawings, and in particular to FIG. 1, a combustion head especially for gaseous fuel, according to the invention has been generally identified by reference numeral 1.

The combustion head 1 is associated with a burner 1*a* which in a manner known per se comprises an internally hollow mixing body 2 into which feeding means 3 for a combustible gas-combustion air mixture opens. In the embodiment shown, said feeding means 3 essentially comprises a feed manifold 4 along which a plurality nozzles 5 is distributed. Through said nozzles a combustible gas coming from a pipe 4*a* terminating at the manifold itself is delivered in the form of a plurality of parallel and suitably spaced jets. The nozzles 5 are such oriented that they direct the gas jets to an inlet slot 6 formed along one side of the mixing body 2.

A lead-in portion 7 and a spread portion 8 extend from the side edges of the inlet slot 6 and they have an extension respectively converging and diverging along the feed direction of the gas ejected from nozzles 5. Said lead-in and spread portions, 7 and preferably integrated in the mixing body structure substantially form an admission nozzle the operation which is based, in a manner known per se, on the Venturi effect, so that the gas ejected from nozzles 5 is subjected to entrain, through the inlet slot 6, a given air percentage drawn from the surrounding atmosphere. Obviously, the air feeding may also occur by forced ventilation, said forced ventilation taking the place of, or being in addition to said admission nozzle.

In an original manner the combustion head 1, located on top of the mixing body 2 so as to form a closure for same, is essentially comprised of a plurality of balls 10 of a predetermined diameter, preferably of ceramic material, physically interconnected with each other in succession at points of mutual tangency. The balls 10, distributed in one or more superposed layers and preferably fastened to each other by a sintering process or gluing, substantially define a filter bed formed with a lattice of intercommunicating alveoli 11 defining close to the external surface 9 of the combustion head 1, a plurality of delivery ports 12 homogeneously distributed over the whole extension of the external surface itself.

The gas-air mixture admitted to the mixing body 2 will be therefore forced to pass through the combustion head 1 and will then emerge from the delivery ports 12 to be fired at the external surface 9 of said combustion head.

Advantageously, the surfaces of balls to confining each delivery port 12 mutually diverge in an exponential progression along the mixture outlet direction, thereby involving an important velocity reduction in the mixture flow coming out of the delivery ports. In this manner, even in the presence of high flow rates of the gas-air mixture, burning of the mixture will take place substantially within the confined spaces between the hall surfaces diverging from the delivery ports 12, thereby giving rise to a substantially continuous flame front extending over the whole external surface 9 of the combustion head 1.

In addition, the balls 10 belonging to each of the different superposed layers are distributed to advantage according to a symmetricaly staggered positioning relative to the balls belonging to the adjoining layers. In this way, the mixture from the mixing body 2, while crossing the combustion head 1, is divided into a plurality of flows which are forced to follow a tortuous path of travel between the various alveoli 11 and are consequently subjected to movement in a turbulent state, which will cause a perfect homogenizing of the mixture to be fired.

To the ends of the present invention, balls 10 may be replaced by granular elements of varying shapes, for example obtained by grinding a ceramic material into a given particle size and subsequently distributed in superposed layers to form said filter bed. At all events the use of balls is preferred because by suitably selecting the ball diameter it is possible to establish he sizes of the alveoli 11 and delivery ports 12 in a very precise manner, depending on requirements. In particular, the ball diameter is provided to be included between 1 mm and 10 mm, so that the alveolus and port sizes will be big enough to enable passage of impurities possibly present in the mixture and small enough to ensure a mixture velocity capable of avoiding any risk of backfire at the delivery ports 12.

Figure 3:
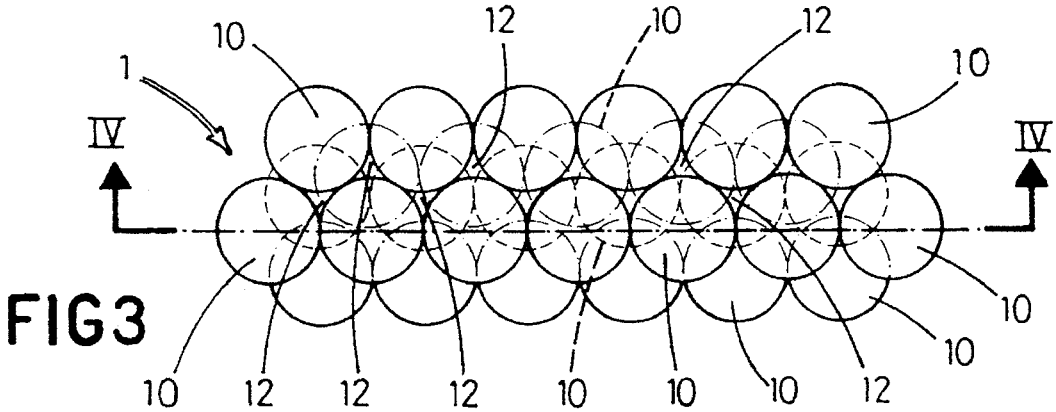
FIG. 3 is a plan view to an enlarged scale of one portion of the combustion head in question.

Obviously, the mutual placement of balls 10 in the individual layers does not represent a limitation to the ends of the present invention. By way of example, FIGS. 2 and 3 show a first solution in which the balls 10 provided in each layer are distributed according to a reticular geometric pattern having triangular meshes. In this case the combustion head 1 has at least three ball layers, so that none of the delivery ports 12 can directly communicate with the inside of the mixing body 2 and therefore each delivery port 12 can be reached by the mixture after the latter has passed through several alveoli 11 disposed at mutually staggered locations.

Figure 5:
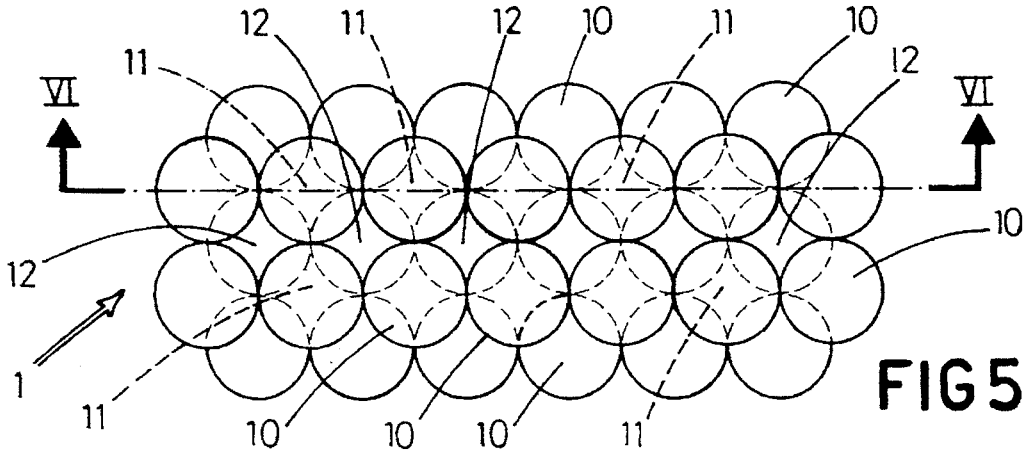
FIG. 5 is a plan view to an enlarged scale of one portion of the combustion head made according to an alternative embodiment of the invention.

In the alternative embodiment shown in FIGS. 4 and 5 the balls 10 of each layer are on the contrary distributed according to a reticular geometric pattern formed of square meshes. In this case the arrangement of at least two ball layers is sufficient to enable the mixture to reach the delivery ports 12 after following a tortuous path across the combustion head 1.

While the burner 1*a* is in operation, the intimate contact between the flame and the balls 10 causes an important heat transmission to the balls. However, since the balls 10 are in contact with each other at the tangency points alone, and since the balls of the underlying layers are constantly cooled by the mixture flow coming from the mixing body 2, heat transmitted to the external surface 9 is substantially confined to said surface so that it encounters a great difficulty in spreading by conduction on the underlying ceramic material.

This situation is very advantageous for the achievement both of a combustion of good quality and a good resistance to thermal shocks by the combustion head 1. In this connection it should be pointed out that the heat concentration on the external surface 9 causes said surface to become incandescent when only small amounts of heat have been built up, thereby achieving an efficient heat dissipation by radiation. This first of all involves an advantageous limitation of the flame temperature, and consequently inhibits production of nitric oxides and/or other harmful products of combustion. In addition, due to the reduced amount of the built up heat, there is an advantageous limitation in the thermal expansions and/or shrinkages undergone by the combustion head 1 as a result of temperature changes and therefore there is an excellent resistance to stresses due to thermal shocks.

Figure 6:
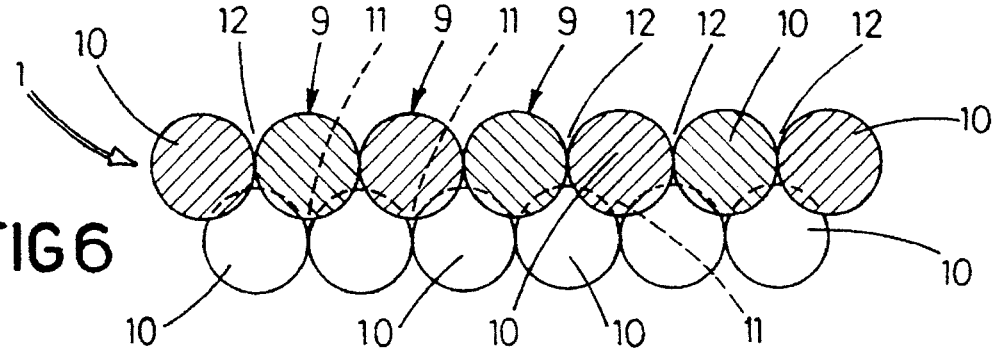
FIG. 6 is a section taken along line VI—VI in FIG. 5

In order to further increase this resistance to thermal shocks, the use of internally hollow balls 10 may be provided, as shown in FIG. 6, so that a further reduction of the ball mass is achieved and therefore a reduction in the heat amount therein stored during burning.

Figure 8:
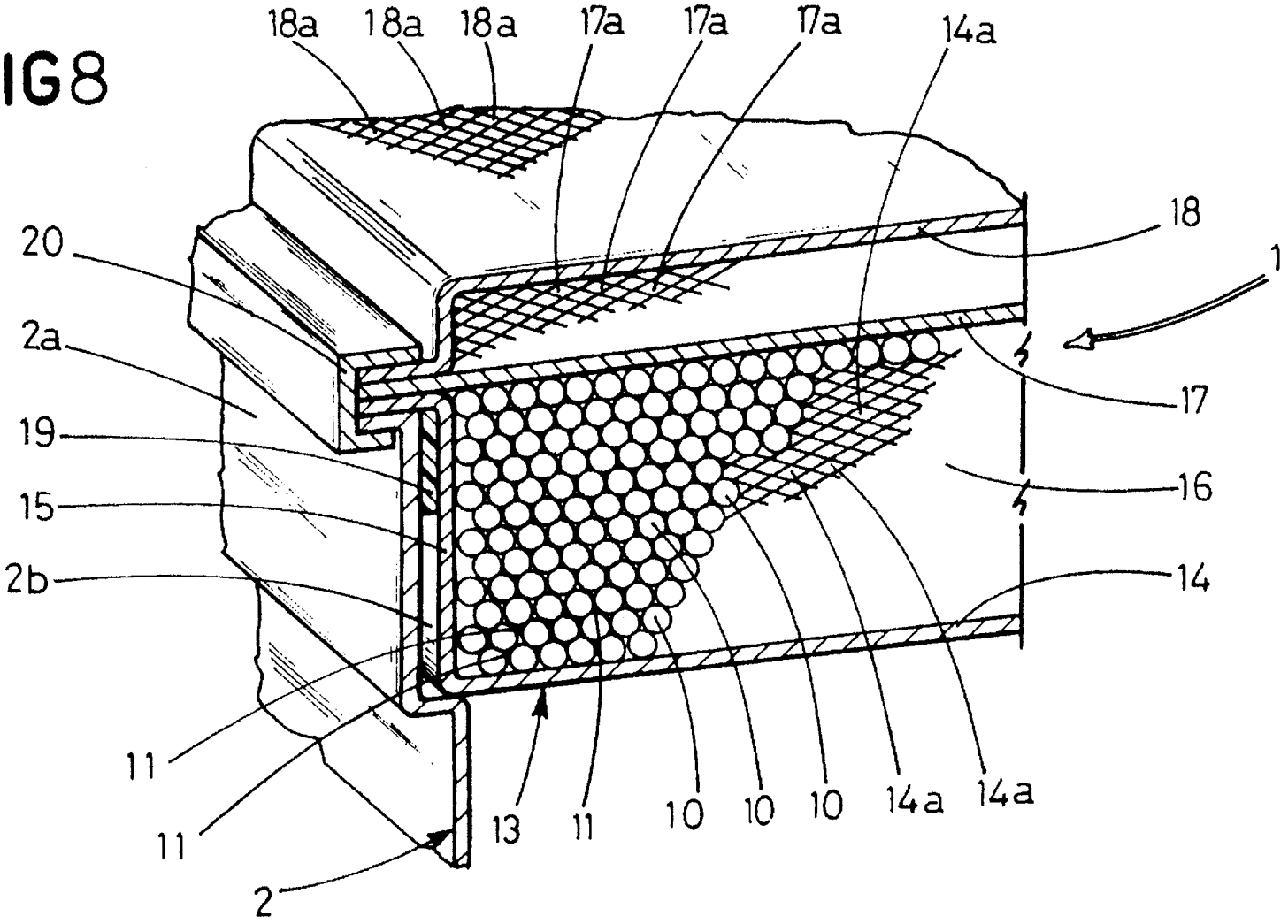
FIG. 8 is a perspective view in split of another example embodying the present invention.

According to an alternative embodiment shown in FIG. 8, the combustion head 1 comprises a box-shaped holding body 13 having at least one bottom 14 provided with a plurality of through apertures 14*a* defining a substantially reticular structure, and at least one side wall 15 extending perimetrically from said bottom 14 with which it defines a housing 16 for receiving said plurality of granular elements consisting in this case (as already said) of balls 10 of a predetermined diameter.

Preferably the box-shaped holding body 13 can be thoroughly made of a suitably shaped reticular element It should be noted that the box-shaped holding body 13 is received in a perimetric seat 2*b* defined by an upper edge 2*a* of the mixing body so that it substantially acts as a closure for the mixing body. Advantageously associated with the holding body 13 is a closing element 17 disposed on the opposite side from the bottom wall 14 and also provided with a plurality of through apertures 17*a* defining a substantially reticular structure. Preferably the closing element 17 too can be made of a reticular element which is suitably shaped so that its shape matches that of the side wall 15 of the holding body 13.

By virtue of the presence of the box-shaped body 13 and respective closing element 17, the granular elements or balls 10 can be disposed within the housing 16 without a mutual fixing being required.

According to another preferential solution, the use of an additional covering element 18 associated with the side wall 15 of the holding body 13 may be provided. It is located a given distance from the closing element 17, away from the bottom wall 14. This additional covering element 18 too, designed to be brought to incandescence by the flame in order to dissipate heat by radiation, is provided with a plurality of through apertures 18*a* and can be made starting directly from a reticular element.

Advantageously, an annular seal 19 is interposed between the side wall 15 of the box-shaped body 13 and the upper edge 2*a* of the mixing body 2. Seal 19 is adapted to ensure an efficient tightness to the connection between the box-shaped body and the mixing body and at the same time, due to its intrinsic capability of being deformed, can compensate for the thermal expansions to which the other components of the combustion head 1 are subjected, thereby avoiding the occurrence of inner stresses capable of impairing the structural integrity of the combustion head.

Clamping means consisting for example of an annular gripping element 20 having a C-shaped transverse section causes the final fastening between the upper edge 2*a* of the mixing body 2, the side wall of the holding body 13, the closing element 17 and the additional closing element 18, if present.

It should be pointed out that the combustion head made following the above alternative solution is easy manufacture and installation.

In greater detail, for manufacturing this combustion head the box-shaped holding body 13 is first made, for example starting from a reticular element or a plate suitably provided with through holes conveniently distributed to form a substantially netlike structure.

At this point, said plurality of granular elements 10 may be introduced into the housing 16 so as to define the filter bed provided with intercommunicating alveoli or hollow spaces 11.

In order to promote compactness of the granular elements 10 poured into the holding body 13, during or after this operation the holding body may be submitted to advantage to a further step involving a vibrating action.

Subsequently, the closing element 17 is put on top of the granular elements and associated therewith and the additional closing element 18, if any, is put close to the upper edge of the side wall 15 of the holding body 13.

At this point the holding body 13 can be associated with the perimetric housing 16 defined by the upper edge 2*a* of the mixing body 2, upon optional interposition of the annular seal 19.

In accordance with the solution shown in FIG. 8, the box-shaped holding body 13, closing element 17 and additional closing element 18 are fastened to the upper edge 2*a* of the mixing body 2 after carrying out a folding operation of the respective perimetric edges and a subsequent operation involving clamping of the perimetric edges by the annular gripping element 20.

The present invention achieves the intended purposes.

The combustion head in question, due to its particular structural configuration, is in fact capable of ensuring an optimal efficiency in carrying out the combustion process on the external surface 9. The combustion thoroughly takes place in the spaces defined by the upper surface portions of the balls at the outside of the delivery ports, which is advantageous .for the combustion quality. Thus an optimal control of the stoichiometric ratio in the gas-air mixture is ensured, together with the maintenance of a fire temperature adapted to avoid the formation of nitric oxides and/or other harmful products of combustion.

The combustion quality is also improved by the intimate mixing taking place between time air and gas following passage of the mixture through the lattice of alveoli defined by the different ball layers.

In addition, due to the restrained thermal inertia given to the combustion head in question, which inertia can be further reduced if internally hollow balls are used, it is possible to reach an exceptional resistance to thermal shocks occurring for example on firing of the burner and/or as a result of an accidental dropping of cold liquids onto the combustion head.

It should be recognized that the combustion head according to the invention can be mass produced at low manufacturing costs. Actually, it is noted that hollow or solid balls made of ceramic material are easily available on the market. In addition the manufacturing cost can be further reduced if, instead of balls, granular elements of different configuration obtained by grinding of scrap material from other industrial processes are used.

Obviously, many modifications and variations may be made to the present invention without departing from the inventive idea characterizing it. For example, the combustion head may be made of several plate-like portions formed by said balls or granular elements of different shapes, disposed consecutively side by side and supported by a bearing framework.

In addition, for producing particular types of burners, the balls may be distributed in a tubular configuration, instead of having a flat configuration as shown in the accompanying drawings. In the case of a cylindrical tubular configuration, the balls may advantageously have a diameter increasingly growing from the inner to the outer layers in order to ensure that also the balls belonging to the outermost layers should be touching at the respective tangency points.

What is claimed is:

1. A gas burner comprising:

an internally hollow mixing body (2), means (3) for feeding a combustible gas-combustion air mixture into the mixing body (2), a combustion head (1) provided with delivery ports (12) through which the combustible gas-combustion air mixture is ejected from the mixing body (2) and fired, said combustion head comprising:

a box-shaped holding body (13) received in a perimetric seat (2*b*) defined by an upper edge (2*a*) of said mixing body (2), said box-shaped body having at least one bottom (14) provided with a plurality of through apertures (14*a*) and at least one side wall (15) extending perimetrically from said bottom (14) with which it defines a housing (16) a plurality of granular elements (10) received in said housing (16) defined in the box-shaped body, said granular elements being physically interconnected with each other in succession at points of mutual tangency, to substantially define a filter bed having a lattice of hollow spaces (11) intercommunicating with each other and defining on an external surface (9) of the combustion head (1), a plurality of said delivery ports (12) distributed over the whole extension of the external surface itself.

2. The gas burner as claimed in claim 1, wherein said granular elements consist of balls (10) a predetermined diameter.

3. The gas burner as claimed in claim 1, wherein said granular elements (10) are made of a ceramic material.

4. The gas burner as claimed in claim 2, wherein said balls (10) are internally hollow.

5. The gas burner as claimed in claim 2, wherein said predetermined diameter for each of said balls (10) has a value included between 1 mm and 10 min.

6. The gas burner as claimed in claim 1, wherein said granular elements (10) are joined to each other by sintering at the corresponding tangency points.

7. The gas burner as claimed in claim 1, wherein said granular elements (10) are joined to each other by gluing at the corresponding tangency points.

8. The gas burner as claimed in claim 2, wherein at least one ball layer is provided, in which balls are distributed following a geometric lattice made of triangular meshes.

9. The gas burner as claimed in claim 2, wherein at least one ball layer is provided, in which balls (10) are distributed following a geometric lattice made of square meshes.

10. The gas burner as claimed in claim 8, wherein said balls (10) are distributed in at least three layers overlying each other, the balls belonging to each layer having a symmetricaly staggered positioning relative to the adjacent balls belonging to the other adjoining layers.

11. The gas burner as claimed in claim 9, wherein said balls (10) are distributed in at least two layers overlying each other, the balls belonging to each layer having a symmetrically staggered positioning relative to the adjacent balls belonging to the adjoining layer.

12. The gas burner as claimed in claim 1, wherein said granular elements (10) are interconnected with each other by mutual contact at said tangency points.

13. The gas burner as claimed in claim 1, comprising at least one closing element (17) associated with the side wall (15) of the holding body (13) on the opposite side from the bottom wall (14), said closing element (17) too being provided with a plurality through apertures (17*a*) defining a substantially reticular structure.

14. The gas burner as claimed in claim 1, wherein said box-shaped holding body (13) is formed of a reticular element defining both said bottom (14) and side wall (15).

15. The gas burner as claimed in claim 13, wherein said closing element (17) is formed of a reticular element.

16. The gas burner as claimed in claim 13, comprising an additional closing element (18) associated with said side wall (15) of the holding body (13) and located a given distance from said closing element (17), away from said bottom wall (14), said additional covering element (18) being provided with a plurality through apertures (18*a*) defining a substantially reticular structure.

17. The gas burner as claimed in claim 16, wherein said additional covering element (18) is formed of a reticular element.

18. The gas burner as claimed in claim 1, comprising an annular seal (19) operatively interposed between said side wall (15) of the box-shaped body (13) and said upper edge (2*a*) of the mixing body (2).

19. The gas burner as claimed in claim 13, further comprising clamping means (20) for fastening to each other said upper edge (2*a*) of the mixing body (2), side wall (15) of the holding body (13) and closing element (17).

20. The gas burner as claimed in claim 19, wherein said clamping means comprises an annular gripping element (20) having a substantially C-shaped transverse section.

21. A method of manufacturing and setting up a gas burner comprising an internally hollow mixing body (2), means (3) for feeding a combustible gas-combustion air mixture into the mixing body (2), and a combustion head (1) provided with delivery ports (12) through which the combustible gas-combustion air mixture is ejected from the mixing body (2) and fired, said method comprising the following steps:

manufacturing a box-shaped holding body (13) having at least one bottom wall (14) provided with a plurality of through apertures (14*a*) defining a substantially netlike structure, and at least one side wall (15) extending perimetrically from said bottom wall (14) and defining a housing (16) therewith;

pouring a plurality of granular elements (10) into said housing (16) so as to substantially make a filter bed formed with a lattice of hollow spaces (11) intercommunicating with each other and defining a plurality of said delivery ports (12);

associating with said granular elements (10), on top of the same, a closing element (17) provided with a plurality of through apertures (17*a*) defining a substantially reticular structure;

wherein after said manufacturing step another step is provided in which the box-shaped holding body (13) is engaged in a perimetric seat (2*b*) defined by an upper edge (2*a*) of said mixing body (2).

22. The method as claimed in claim 21, wherein, concurrently with the step of pouring the granular elements (10), the box-shaped holding body is submitted to a step involving a vibrating action.

23. The method as claimed in claim 21, wherein the step of engaging the box-shaped holding body (13) with said perimetric seat (2*b*) is achieved upon interposition of an annular seal extending between the side wall of the holding body and said upper edge of the mixing body (2).

24. The method as claimed in claim 21, wherein after said step of associating the closing element (17) with the holding body (13) another associating step is provided in which an additional covering element (18) is put on top of the closing element (17) and is spaced apart a given distance therefrom, away from said bottom wall (14), said additional covering element (18) being provided with a plurality of through apertures (18*a*) defining a substantially reticular structure.

25. The method as claimed in claim 21, wherein said engaging step is achieved after the associating step.

* * * * *

UNITED STATES PATENT AND TRADEMARK OFFICE

CERTIFICATE OF CORRECTION

PATENT NO. : 5,591,025

DATED : 01/07/97

INVENTOR(S) : Gianmario Invernizzi

It is certified that error appears in the above-indentified patent and that said Letters Patent is hereby corrected as shown below:

Column 7, line 35 delete "10 min" and insert --10 mm--.

Column 7, line 43 after "following a geometric lattice" insert --according to a reticular geometric pattern--

Column 7, line 46 after "following a geometric lattice" insert --according to a reticular geometric pattern".

Column 7, line 63, after "plurality" insert --of--.

Signed and Sealed this

Ninth Day of September, 1997

*Attest:*

*Attesting Officer*

Bruce Lehman

BRUCE LEHMAN

*Commissioner of Patents and Trademarks*